United States Patent [19]

Barden et al.

[11] 4,279,953

[45] Jul. 21, 1981

[54] METHOD FOR TREATING POLYURETHANE FOAM

[75] Inventors: Bruce L. Barden, Mogadore; William D. Coder, Jr., Akron, both of Ohio

[73] Assignee: The General Tire & Rubber Company, Akron, Ohio

[21] Appl. No.: 144,138

[22] Filed: Apr. 28, 1980

[51] Int. Cl.[3] ..... B05D 1/14; B05D 1/16; B32B 33/00

[52] U.S. Cl. ..... 428/90; 427/206; 427/365; 427/372.2; 427/393.5; 428/95; 428/315

[58] Field of Search ..... 427/26, 200, 206, 244, 427/358, 365, 366, 369, 370, 371, 372.2, 393.5, 384, 373; 428/90, 95, 315; 260/29.7 H; 521/123

[56] References Cited

U.S. PATENT DOCUMENTS

| | | | |
|---|---|---|---|
| 2,205,882 | 6/1940 | Graves | 8/94.19 R |
| 2,663,097 | 12/1953 | Giese | 427/206 |
| 2,900,278 | 8/1959 | Powers et al. | 427/244 |
| 3,360,415 | 12/1967 | Hellman et al. | 427/393.5 |
| 3,468,833 | 9/1969 | Meincke | 260/29.7 R |
| 3,674,611 | 7/1972 | Petry et al. | 428/90 |
| 3,897,372 | 7/1972 | Kehr et al. | 521/123 |
| 3,900,651 | 8/1975 | Hoppe et al. | 428/90 |
| 4,049,848 | 9/1977 | Goodale et al. | 427/358 |
| 4,066,578 | 1/1978 | Murch et al. | 521/123 |
| 4,098,944 | 7/1978 | Pollock | 428/95 |
| 4,145,494 | 3/1979 | Neubert | 260/29.7 |
| 4,194,026 | 3/1980 | Goodale et al. | 427/365 |

FOREIGN PATENT DOCUMENTS

| | | | |
|---|---|---|---|
| 50-77474 | 6/1975 | Japan | 427/244 |

*Primary Examiner*—Ronald H. Smith
*Assistant Examiner*—S. L. Childs

[57] ABSTRACT

The outer surface layers of a flexible polyetherurethane foam are impregnated and dried with a latex of a flexible carboxylated styrene-butadiene type copolymer to provide a polyurethane foam having a surface which resists degradation in contact with a hot metal, e.g., steel, surface.

10 Claims, No Drawings

METHOD FOR TREATING POLYURETHANE FOAM

This invention relates to a method for treating the outer surface layers of a polyetherurethane foam with a carboxylated polymer to enable the foam to resist heat degradation.

BACKGROUND OF THE INVENTION

The carpeting for some vehicles like automobiles is made from a woven or nonwoven yarn bonded to an adhesive layer of a thermoplastic composition like an ethylene-vinyl acetate copolymer which assembly is molded to a backing of a fabric of scrap textile fibers or yarns into the shape of the metal front and/or rear floor pan of the car. The textile backing of the laminate is the layer which is in contact with the metal floor pans of the car. However, the textile backing is generally not uniform and does not have satisfactory set characteristics. Disposing a thin urethane foam layer between the textile fiber layer and the thermoplastic does improve somewhat the overall properties of the carpet but does not avoid the lack of uniformity of the textile layer adjacent the metal. It is desired to replace the textile backing with a more uniform material like a polyurethane. However, the urethane foam in contact with steel plate at a temperature of about 450 degrees F. (232 degrees C.) for one hour tends to degrade (the surface layers become crumbly).

The need for a surface in contact with metal which does not heat degrade is desirable for cars which have catalytic converters which are generally positioned under the body portion of the car and which generate substantial amounts of heat during operation of the car. While the catalytic converter does contain a heat shield, it is possible that the heat shield may be damaged or lost, and it is desired to provide the carpet with a layer which does not heat degrade in the event the metal floor pan of the car becomes excessively hot due, for instance, to the loss of the heat shield from the catalytic converter.

OBJECTS

Accordingly it is an object of this invention to provide a polyetherurethane foam with a surface which resists heat degradation. Another object of this invention is to provide a method for treating a polyetherurethane foam in order to render the surface or outer surface layers of the foam resistant to heat degradation.

These and other objects of the present invention will become more apparent to those skilled in the art from the following detailed description and examples.

SUMMARY OF THE INVENTION

According to the present invention, it has been discovered that the outer surface layers of a flexible open-cell polyetherurethane foam can be impregnated with a latex of a carboxylated butadiene-styrene type copolymer and dried to drive off the water to provide the polyetherurethane foam with an outer surface or surface layers containing a coating of the carboxylated copolymer which does not degrade when in contact with a steel plate at about 450 degrees F. (232 degrees C.) for one hour, in other words, the foam does not become crumbly. The present invention, thus, has particular application to the manufacture of automobile carpets, or rugs, particularly with respect to the carpet or rug underlay which is to be adjacent the steel or metal floor or pan of the automobile. The latex is believed to coat the cell walls and ribs of the polyurethane foam to prevent heat degradation and to replace or reinforce any of the polyurethane cell walls or ribs which may still be affected by the heat.

While this invention is particularly useful with respect to polyetherurethane foams useful as carpet or rug backings, it will be appreciated that it will be applicable to any polyetherurethane foam to protect its surface from degradation (becoming crumbly) when in contact with a hot metal surface (at about 450 degrees F. (232 degrees C.) for one hour). Thus, the product of the present invention, also, will have applications in door panels and walls of vehicles, seats and fire walls as well as for cushions, mattresses, pillows and so forth.

Moreover, while the carboxylated latex is generally applied to one surface of the polyetherurethane foam layer or web, it can be applied to the opposite surface or to all surfaces.

DISCUSSION OF DETAILS AND PREFERRED EMBODIMENTS

Polyols used in making the flexible open-cell (which includes semi-flexible) polyurethane foam of the present invention are generally primary and secondary hydroxy-terminated polyoxyalkylene ethers having from 2 to 4 hydroxyl groups and a molecular weight of from about 1,000 to 10,000, preferably having 3 hydroxyl groups and a molecular weight of from about 2,000 to 5,000. They are liquids or are capable of being liquefied or melted for handling in the polyurethane foaming apparatus or machine.

Examples of polyoxyalkylene polyols include linear and branched polyethers having a plurality of ether linkages and containing at least two hydroxyl groups and being substantially free from functional groups other than hydroxyl groups. Among the polyoxyalkylene polyols which are useful in the practice of this invention are the polyoxypropylene, the polyoxypropylene-oxyethylene, and the polyoxybutylene glycols and triols. Among the polymers and copolymers that deserve some special mention are the ethylene oxide, propylene oxide and butylene oxide adducts of ethylene glycol, propylene glycol, diethylene glycol, dipropylene glycol, triethylene glycol, 2-ethylhexanediol-1,3, glycerol, 1,2,6-hexanetriol, trimethylolpropane, trimethylolethane, pentaerythritol, triethanolamine, triisopropanolamine, ethylenediamine, and ethanolamine and so forth. Linear and branched copolyethers of other alkylene oxides are also useful in making the foamed products of this invention as well as the polyoxypropylene diols, triols and tetrols endblocked with ethylene oxide to provide primary hydroxyl groups in the polymer. Block and random polyoxyalkylene polyols may be used.

An example of a useful type of polyetherpolyol is characterized by reference to the following general formula:

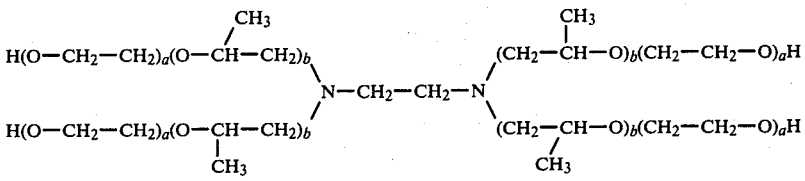

where in the formula the total of subscripts a and b represent positive integers in the range of from 20 to 100. Branched polyethers have the advantage of making possible cross-linking without the interaction of urea or urethane groups with the isocyanate groups. This has the advantage of making a larger proportion of the isocyanate used available for the evolution of carbon dioxide and the reducing of the overall amount of isocyanate that is required in the preparation of the foamed polymer. Mixtures of polyether polyols can be used.

Likewise, there can be used as polyols grafts of ethylenically unsaturated monomers such as acrylonitrile, methacrylonitrile, vinyl acetate, methyl acrylate and the like on the polyols and having the functionality and molecular weight as shown above. Such graft polyols and methods for making the same are shown in U.S. Pat. to Stamberger, Nos. 3,304,273 and 3,383,351 and in U.S. Pat. to Von Bonin, No. 3,294,711 where the monomer or monomers are polymerized with a free-radical or other catalyst in admixture with the polyol.

When desired, cross-linking materials having from 2 to 8 hydroxyl groups can be included in the foam formulation to increase cross link density and so forth. They have molecular weights of from about 60 to 600. Only small amounts of such materials are generally needed (about 0.3 to 10 mols per 100 mols of polyol). Examples of such crosslinking agents are glycol, diethylene glycol, propylene glycol, butane diol-1,4, dipropylene glycol, glycerol, trimethylolpropane, butane triols, hexanetriols, trimethylolphenol, various tetrols, such as erythritol and pentaerythritol, pentols, hexols, such as dipentaerythritol and sorbitol, as well as alkyl glucosides, carbohydrates, polyhydroxy fatty acid esters such as castor oil and polyoxy alkylated derivatives of poly-functional compounds having three or more reactive hydrogen atoms, such as, for example, the reaction product of trimethylolpropane, glycerol, 1,2,6-hexanetriol, sorbitol and other polyols with ethylene oxide, propylene oxide, or other alkylene epoxides or mixtures thereof, e.g., mixtures of ethylene and propylene oxides. Grafted crosslinkers can be prepared by the process of the aforementioned Stamberger and Von Bonin U.S. Patents. Mixtures of crosslinkers can be used.

While any organic di or triisocyanate can be used in the practice of the present invention, diisocyanates are preferred, particularly when there is any considerable amount of branching in the polyol or crosslinker to avoid the formation of rigid foams. Moreover, diisocyanates which are liquid at ambient or room (about 25 degrees C.) temperature are preferred. Examples of suitable organic polyisocyanates to use are hexamethylene diisocyanate, trimethyl hexamethylene diisocyanate, 2,4,-tolylene diisocyanate, 2,6,-tolylene diisocyanate, 4,4'-diphenylmethane diisocyanate, 4,4'-dicyclohexyl methane diisocyanate, polymeric forms of TD1, MD1 and hydrogenated MD1, xylene diisocyanate and isophorone diisocyanate and the like. Mixtures of the polyisocyanates can be used.

The polyisocyanate is used in an amount sufficient to react with the active hydrogen atoms (as determined by the Zerewitinoff method, J.A.C.S., Vol. 49, p. 3181 (1927)) in the polyols, crosslinkers, water and any other active hydrogen-containing material in the polyurethane foam formulation to provide the desired degree of crosslinking, chain extension, urea groups, blowing and so forth to obtain the desired flexibility, strength and other physical properties.

Water is used as a blowing agent and is employed in amounts of from about 1.0 to 6.5 parts by weight per 100 parts by weight of the polyol.

The water should be substantially or essentially pure, that is, it should be free of impurities such as ions, sols, etc. of mineral, vegetable or synthetic origin and the like which would adversely affect the foaming action or the properties of the resultant polyurethane foam. Deionized, distilled or otherwise purified water should be employed.

If lower density and softer foams are desired there additionally can be added to the polyurethane foam formulation separately or in admixture with one of the other components, i.e., polyol or polyisocyanate, etc., up to about 25 parts by weight of a fluorocarbon blowing agent per 100 parts by weight of the polyol. Examples of such blowing agents are those fluorine substituted aliphatic hydrocarbons which have boiling points between about −40 degrees C. and +170 degrees C., and which vaporize at or below the temperature of the foaming mass. The blowing agents include, for example, trichloromonofluoromethane, dichlorodifluoromethane, dichloromonofluoromethane, bromotrifluoromethane, chlorodifluoromethane, 1, 1-dichloro-1-fluoroethane, 1,1-difluoro-1,2,2-trichloroethane, chloropentafluoroethane, 1-chloro-1-fluoroethane, 1-chloro-2-fluoroethane, 1,1,2-trichloro-1,2,2-trifluoroethane, 1,1,1-trichloro-2,2,2-trifluoroethane, 2-chloro-nonafluoro-butane, hexafluorocyclobutane and octafluorocyclobutane. Still other easily vaporizable fluorocarbons can be used. Mixtures of the fluorocarbons can be used. Less desirable, blowing agents can be used in full or partial replacement of the fluorocarbons such as propane, butane, pentane, pentene, hexane and so forth, and mixtures thereof, particularly where precautions are taken to prevent explosions and/or fires or where removal of the gasses is provided.

Catalysts are added to accelerate the different urethane reactions. The chain-extension reaction, where the polyol reacts with the isocyanate to produce the polyurethane, is accelerated by tertiary amines and metalorganic catalysts. The tertiary amines, also, catalyze the gas-forming isocyanate-water reaction. Suitable tertiary amines are well known and include triethylene diamine, tetramethyl-butane diamine, triethylamine, N-methyl morpholine, N-ethyl morpholine, diethyl ethanolamine, N-coco morpholine, 1-methyl-4-dimethylamino ethyl piperazine, 3-methoxy-N-dimethylpropyl amine, N-N-diethyl-3-diethylamino propyl amine and dimethyl benzyl amine and the like and mixture thereof. The metal organic catalysts are also well known, tin catalysts being generally preferred, especially the divalent tin salts of carboxy acids having 2 to 18 carbon atoms. Examples of such catalysts include dibutyl tin dilaurate, stannous chloride, dibutyl tin di-2-ethyl hexoate, stannous octoate and stannous oleate.

The tin catalysts are used in an amount of from about 0.1 to 0.9 part by weight per 100 parts by weight of the polyetherpolyol. The amount of organic amine catalyst may comprise, per 100 parts by weight of organic polyol, about 0.05 to 3.2 parts by weight. In the case of the polyether polyols where the metal catalyst is used for the urethane-forming reaction, it is preferred to use only from about 0.05 to 1.1 part by weight of the amine catalyst. On the other hand, where the tertiary amine is taking care of both the foaming ($H_2O+NCO$) and network (—ROH+NCO) reactions, the tertiary amines should be used in somewhat larger amounts within the specified ranges. However, since some polyols may differ in residual acid content (from neutralization of KOH catalyst (used to form polyol) with acid) due to incomplete washing, filtering or ion-exchanging of the neutralized polyol, the amount of tertiary amine may necessarily have to be changed where large amounts of water are used as the primary blowing agent.

Surfactants or emulsifiers are generally necessary to provide the desired cell formation and growth. Polysiloxane-polyoxyalkylene block copolymers are preferred. Polysiloxane-polyoxyalkylene block copolymers are described in U.S. Pat. Nos. 2,834,748 and 2,917,480. The surfactant "non-hydrolyzable" polysiloxane-polyoxyalkylene block copolymers where the polysiloxane moiety is bonded to the polyoxyalkylene moiety through direct carbon-to-silicon bonds, rather than through carbon-to-oxygen-to-silicon bonds, can be used. Cyano containing polysiloxane-polyoxyalkylene copolymers also can be used as surfactants (U.S. Pat. No. 3,846,462); they also, are helpful in producing flame retardant polyurethane foam formulations. These copolymers generally contain from 5 to 95 weight percent, and preferably from 5 to 50 weight percent, of polysiloxane polymer with the remainder being polyoxyalkylene polymer. The copolymers can be prepared, for example, by heating a mixture of (a) a polysiloxane polymer containing a silicon-bonded, halogen-substituted monovalent hydrocarbon group and (b) an alkali metal salt of a polyoxyalkylene polymer to a temperature sufficient to cause the polysiloxane polymer and the salt to react to form the block copolymer. Still other polysiloxane-polyoxyalkylene copolymers known to the art may be employed as well as silicones, turkey red oil and so forth. The surfactant is used in an amount of from about 0.3 to 2.5 parts by weight per 100 parts by weight of the polyether polyol.

The polyurethane form or foam formulation additionally contains from about 30 to 70, preferably from about 40 to 60, parts by weight of aluminum trihydrate ($Al_2O_3.3H_2O$ or $Al(OH)_3$, also known as aluminum hydroxide, aluminum hydrate, alumina hydrate, hydrated alumina ("The Merck Index," Seventh Edition, Merck & Co., Inc., Rahway, N.J., 1960, page 43, and "Materials, Compounding Ingredients And Machinery For Rubber," Bill Communications, Inc., New York, 1978, page 100) per 100 parts by weight of the polyalkylene ether-polyol used in the foam.

The preparation of the polyurethane foams of the present invention can be formed by a process known in the art as the "one-shot" process or by a two step process involving, first, the preparation of a "prepolymer," the well known "semi-prepolymer" or "quasi-prepolymer" technique. There all or a portion of the polyol is reacted with all of the organic polyisocyanate, providing a reaction product which contains a high percentage of free isocyanate groups and which is reacted with the remaining portion of the hydroxyl-terminated polyol or a crosslinker, together with water, catalysts, $Al_2O_3.3H_2O$ etc. to form a rubbery, cellular, elastic or flexible product.

The polyurethane foams can be molded as such into the desired dimensions. However, it is preferred to form the polyurethane foam into a bun or slab and then to cut or slit (slice) the foam into sheets of the desired thickness which then may be cut to the desired configuration. If desired, the foam may be made into a log or the like and then peeled and cut.

For more information on the preparation of the polyurethane foams please see "Encyclopedia of Chemical Technology," KirkOthmer, Vol. 21, 2nd Ed., pages 56 to 106, Interscience Publishers a Division of John Wiley & Sons, Inc., New York, 1970; "Encyclopedia of Polymer Science And Technology," Vol. 15, pages 445 to 479, Interscience Publishers a division of John Wiley & Sons, Inc., New York, 1971 and Saunders and Frisch, "Polyurethanes," Chemistry and Technology, Part II. Technology, High Polymers, Vol. XVI, Interscience Publishers a division of John Wiley & Sons, Inc., New York, 1964.

The latex used in practice of the present invention is an aqueous free radical emulsion copolymerized flexible COOH containing copolymer or mixtures of such copolymers. Examples of such polymers are the copolymers of (A) butadiene-1,3, piperylene, isoprene, 2,3-dimethyl butadiene-1,3 and other dienes of 4 to 6 carbon atoms and mixtures thereof with (B) a copolymerizable unsaturated acid such as acrylic acid, methacrylic acid, ethacrylic acid, sorbic acid, maleic acid, fumaric acid, itaconic acid, vinyl benzoic acid, crotonic acid, citraconic acid, and the like and mixtures thereof and with (C) a copolymerizable monomer such as styrene, alphamethyl styrene and vinyl toluene and the like mixtures thereof. These COOH containing copolymers may be prepared in aqueous emulsion systems using conventional emulsifiers, chain transfer agents, antioxidants, short-stop agents, free-radical catalysts, chelating agents and so forth as is well known to the art. After polymerization, the latex is neutralized or made alkaline. Furthermore, after polymerization, the latex may be chemically (by adding more catalyst) stripped or physically (steamed or degassed) stripped to tie up or remove residual monomer(s). Method for making these polymers are disclosed in U.S. Pat. Nos. 2,604,668; 2,669,550; 2,710,292; 2,724,707; 2,849,426; 2,868,754; 3,392,048; 3,404,116; 3,409,569; 3,468,833 and 4,145,494. Please, also, see "Rubber World," September, 1954, pages 784 to 788 and "Industrial and Engineering Chemistry," May, 1955, pages 1006 to 1012. The latex can have a solids content of from about 30 to 60%, have a pH of from about 7.5 to 11.5 and have a Brookfield viscosity of from about 50 to 350 (LVF Model #2 Spindle @ 60 rpm) cps at 25 degrees C.

While an ester of the acid or the acid anhydride and so forth can be copolymerized instead of the acid and then hydroloyzed and neutralized to form acid groups or salt groups in the copolymer, this procedure is not as convenient as directly polymerizing the acidic monomer with the other copolymerizable monomer(s).

Free-radical aqueous emulsion copolymerization to make random, linear, branched or graft copolymers is well known. The copolymers may be of high or low molecular weight and may contain gel or little or no gel depending on the degree of polymerization and the use of modifiers. In this connection reference is made to "Encyclopedia of Polymer Science and Technology," Interscience Publishers a division of John Wiley & Sons, Inc., New York, Vol. 2 (1965) pages 278–295, Vol. 3, (1965) pages 26–29, Vol. 5 (1966) pages 801–859, Vol. 7 (1967) pages 361–431 and Vol. 9 (1968) pages 814–841; Bovey et al, "Emulsion Polymerization," Interscience Publishers, Inc., New York, 1955; Whitby et al, "Synthetic Rubber," John Wiley & Sons, Inc., New York, 1954; Schildnecht, "Vinyl and Related Polymers," John Wiley & Sons, Inc. New York, 1952; "Copolymerization," High Polymers, Vol. XVIII, Ham, pages 323–324, 335–420 and 573, Interscience Publishers a division of John Wiley & Sons, New York, 1964; "Block and Graft Polymers," Burlant and Hoffman, Reinhold Publishing Corporation, New York, 1960; "Block and Graft Copolymers," Ceresa, Butterworth & Co. (Publishers) Ltd., London, 1962; "Graft Copolymers," Polymer Reviews, Vol. 16, Battaerd and Tregear, Interscience Publishers, a division of John Wiley & Sons, New York, 1967; U.S. Pat. No. 3,914,340; "Latex In Industry," Noble, 2nd Ed., 1953, Rubber Age, Palmerton Publishing Co., New York and "High Polymer Latices," Blackley, 1966, Vols. 1 and 2, Macluren & Sons Ltd., London.

Where persulfate is used in the polymerization of the COOH containing polymer, a compound such as barium carbonate should be added to the latex as a scavenger for any sulfur containing compound from the persulfate and which might harm the polyurethane foam. Also, sodium and potassium bicarbonates, carbonates and hydroxides should not be used during polymerization of the COOH containing polymer, or the polymeric latex should not contain these materials, since they or their decomposition products may adversely affect the foam at elevated temperatures.

The COOH containing copolymer of the latex contains on a dry weight basis from about 25 to 55 parts by weight of the diene monomer (A), from about 1 to 4 parts of the COOH monomer (B) and from about 40 to 70 parts of the vinyl aryl monomer (C). Preferred copolymers are the copolymers of butadiene-1,3, a mixture of itaconic and methacrylic acids and styrene.

The COOH containing copolymer latex before use is compounded with minor amounts of suitable compounding ingredients to stabilize and neutralize it, particularly against any strong acid or base ions, as well as to increase its dispersibility and handling and so forth. Examples of such ingredients are water, buffers, biocides, surfactants, scavengers, antioxidants, pigments and thickeners and so forth. Some examples of these compounding ingredients are ammonia neutralized sodium acid pyrophosphate, nonionic surfactant such as the reaction product of t-octyl phenol with ethylene oxide (e.g. containing 9–10 ethylene oxide groups), non-hydrolyzable polysiloxane-polyalkylene ether surfactants, barium carbonate, polymerized 1,2-dihydro-2,2,4-trimethyl-quinoline antioxidant, carbon black dispersion, anionic dispersant or stabilizer like the sodium salt of condensed naphthalene sulfonic acid, sodium polyacrylate thickener and 1,2-benzisothiazolin-3-one biocide and so forth.

The compounded aqueous alkaline COOH copolymer latex composition can be applied to the back of or to one side of the foam by spray coating, air knife coating, blade coating, brush-finish coating, cast coating, flow-on-coating, knife coating, machine coating, polished drum coating, print on coating, roll coating, dipping, wire wound rod casting and so forth.

The aqueous compounded latex composition is applied to the back of the foam at a coating weight of from about 2 to 12, preferably from about 4 to 10, oz./sq. yard on the foam. The foam coated with the latex composition is then pressed for example by passing through rollers or by means of a calender and the like to force the latex into the outer layers of the back of the foam to a depth from the surface of from about 15 to 35%, preferably from about 20 to 30%, of the volume thickness of the foam. The force used during the impregnation or pressing step should be sufficient to force the latex into the foam to the desired depth without adversely affecting the dimensions and physical properties of the foam itself. The coating and impregnating, of course, can be done in one step. While the latex coated and pressed foam may be dried at room temperature (about 25 degrees C.), it is preferred to heat it at temperatures of up to about 375 degrees F. (191 degrees C.) to reduce the time of drying and without deterioration. The final dry weight of the impregnated foam, or the increase in the weight of the foam, due to coating of and impregnating by the carboxylated copolymer composition is from about 1.0 to 6.0 oz./sq.yd., preferably about 2.0 to 5.0 oz./sq.yd., on the foam. The foam impregnated with the dried COOH copolymer does not exhibit any visual change in thickness or dimensions. If desired to reduce slipping and after passing the latex coated foam thru the roller and prior to drying, the latex impregnated foam may be flocked (flock, finely divided fiber, flock coated) with heat resistant fibrous material (short fibers) of nylon, polyester, rayon, cotton or glass or mixture thereof, and, then after drying any excess flock is removed to provide a further increase in dry weight of the foam due to the flocking of about 0.25 to 0.75 oz./sq.yd.

The following example in which all parts are parts by weight unless otherwise shown will serve to illustrate the present invention with more particularity to those skilled in the art.

Example

A flexible, open-cell, low-breathability water blown polyetherurethane foam about 2 lb./cu.ft. density was made from tolylene diisocyanate and a secondary hydroxyl terminated polypropylene ether-ethylene ether triol having an average molecular weight of about 3500, an OH number of about 48 and from about 11–14% by weight of ethylene oxide units. The foam contained about 50 parts by weight of alimunum trihydrate per 100 parts by weight of the polyether triol in the polyurethane foam.

A. A flat surface of a sample of the foam ¾ inch thick placed against a steel plate which has heated at about 450 degrees F. (232 degrees C.) for one hour degraded (as evidenced by crumbling of the outer 1/32–1/16 inch layer (surface) of the foam which had been in contact with the steel).

B. A similar sample of the foam but without the aluminum trihydrate under the same testing conditions as A. above degraded (as evidenced by crumbling of the outer 1/8+ inch layer of the foam in contact with the steel).

C. A similar sample of the above foam containing the $Al_2O_3.3H_2O$ was sprayed on one side with an aqueous alkaline compounded latex composition (about 50% by weight of solids of which about 90% is copolymer solids) of a flexible copolymer of about 55% by weight of styrene, about 2% by weight of a mixture of methacrylic acid and itaconic acid, and the balance butadiene-1,3 at a coating weight of about 8 oz./sq.yd. (wet). The coated foam was then passed through steel rollers set at a 90 mills gap to press the latex into the outer layers on one side of the foam to a depth from the surface of about 25% of the volume thickness of the foam. The coated and pressed foam was then dried in air at ca. 350 degrees F. (177 degrees C.) for about 15 minutes. The surface of the resulting dried foam was not sticky nor soft. The increase in weight of the foam by virtue of the polymer composition was about 3.2 oz./sq.yd. (dry). The latex impregnated air dried surface of the foam was tested against the steel plate heated at about 450 degrees F. for one hour under the same conditions as described above under A. and showed no signs of degradation (no crumbling).

D. The method of Run C above was repeated except that the latex coated and pressed foam was flocked with 3.0 denier nylon flock prior to drying. After drying and removing excess flock, the dry weight increase of the foam was about 0.5 oz/sq.yd. The flocked surface of the foam was tested against the steel plate heated at about 450 degrees F. for one hour as described above under A. and did not show any signs of degradation (crumbling).

E. The method of this run was the same as that of Run C, above, except that in place of the above carboxylated copolymer latex the following polymeric latices were used:

1. Emulsion free-radical cold polymerized copolymer of butadiene-1,3 and styrene containing about 23.5% bound styrene.
2. Neoprene.
3. Emulsion free-radical polymerized copolymer of about 70 parts by weight of butadiene-1,3, 15 parts of styrene and 15 parts of 2-vinyl pyridine.
4. Emulsion free-radical polymerized polybutadiene.
5. Copolymer of ethylacrylate and acrylonitrile containing about 2% acrylic acid.
6. Free-radical emulsion polymerized carboxylated styrene and butadiene-1,3 copolymer containing about 2% by weight of hydroxyethylacrylate.

In each case using the polymers of Runs 1 to 6, above, on heat testing according to Run C, above, the resulting foams were degraded (surface crumbled at least ⅛ inch). Additionally, the surface of the foam of 4 after drying the latex was soft and sticky.

We claim:

1. The method which comprises coating at least one surface of a flexible, open-cell polyetherurethane foam with an aqueous alkaline compounded carboxylated copolymer latex composition at a coating weight of from about 2 to 12 ounces per square yard on the foam, pressing said coating on said foam to impregnate the outer surface layers of said foam to a depth of from about 15 to 35% of the volume thickness of said foam and drying said impregnated foam at a temperature of up to about 375 degrees F. to provide said foam with an outer surface layer which resists heat degradation, the dry weight of said latex being from about 1.0 to 6.0 ounces per square yard on the foam, I. said polyetherurethane containing from about 30 to 70 parts by weight of aluminum trihydrate per 100 parts by weight of the polyalkylenether polyol moieties of said foam and II. said carboxylated copolymer of said latex composition being a copolymer of:

a. from about 25 to 55 parts by weight of at least one monomer selected from the group consisting of butadiene-1,3, piperylene, isoprene and 2,3-dimethyl butadiene-1,3, b. from about 1 to 4 parts by weight of at least one monomer selected from the group consisting of acrylic acid, methacrylic acid, ethacrylic acid, sorbic acid, maleic acid, fumaric acid, itaconic acid, vinyl benzoic acid, crotonic acid and citraconic acid and c. from about 40 to 70 parts by weight of at least one monomer selected from the group consisting of styrene, alpha-methyl styrene and vinyl toluene.

2. The method according to claim 1 where the coating weight of said latex composition is from about 4 to 10 ounces per square yard on the foam, where said foam is impregnated with said latex composition to a depth of from about 20 to 30% of the volume thickness of the foam, where the dry weight of said latex is from about 2.0 to 5.0 ounces per square yard on the foam and where said aluminum trihydrate is used in an amount of from about 40 to 60 parts by weight.

3. The method according to claim 2 where a. is butadiene-1,3, where b. is a mixture of itaconic acid and methacrylic acid, and where c. is styrene.

4. The method according to claim 3 where the aluminum trihydrate is used in an amount of about 50 parts by weight, where c. is used in an amount of about 55 parts by weight, where b is used in amount of about 2 parts by weight, where a. is the balance, where the latex composition coating weight is about 8 ounces per square yard on the foam, where the coating is impregnated to a depth of about 25% of the volume thickness of said foam, where the impregnated foam is dried at about 350 degrees F. for about 15 minutes and where the dry weight of said latex on said foam is about 3.2 ounces per square yard.

5. The method according to claim 1 containing the additional steps, prior to drying said latex composition impregnated foam, of flocking the treated surface with fiber flock selected from the group consisting of nylon, polyester, rayon, cotton and glass flock and mixture of the same and after drying removing any excess flock remaining.

6. The product produced by the method of claim 1.
7. The product produced by the method of claim 2.
8. The product produced by the method of claim 3.
9. The product produced by the method of claim 4.
10. The product produced by the method of claim 5.

* * * * *